US005894999A

United States Patent [19]

Moessmer et al.

[11] Patent Number: 5,894,999

[45] Date of Patent: Apr. 20, 1999

[54] FOOD PROCESSING APPARATUS

[75] Inventors: Michael Moessmer, Betzweilerwaelde; Eberhard Haack, Halle, both of Germany

[73] Assignee: Maschinenfabrik Dornhan GmbH., Dornhan, Germany

[21] Appl. No.: 08/926,227

[22] Filed: Sep. 9, 1997

[30] Foreign Application Priority Data

Sep. 16, 1996 [DE] Germany ..... 196 37 665

[51] Int. Cl.[6] ..... B02C 18/30

[52] U.S. Cl. ..... 241/82.1; 241/82.2; 241/82.4

[58] Field of Search ..... 241/82.1, 82.4, 241/82.2, 260.1

[56] References Cited

U.S. PATENT DOCUMENTS

| | | | |
|---|---|---|---|
| 800,452 | 9/1905 | Kohn | 241/82.4 |
| 1,435,796 | 11/1922 | Bennett | 241/82.4 |
| 2,166,197 | 7/1939 | Schaub | 241/82.4 |
| 2,200,786 | 5/1940 | Ardrey | 241/82.4 |
| 2,229,845 | 1/1941 | Gold | 241/82.4 |
| 3,971,514 | 7/1976 | Martinelli et al. | 241/82.4 |
| 4,358,061 | 11/1982 | Richter | 241/82.4 |

*Primary Examiner*—John M. Husar
*Attorney, Agent, or Firm*—Karl Hormann

[57] ABSTRACT

A food processing apparatus useful as an attachment of meat grinders to provide an extension of the pressure barrel thereof. Within the extension, there is provided a feed screw the flutes of which have openings of predetermined sizes, preferably disposed in peripheral sections of the flutes, for imposing multiple sequential divisions and reverse flow on at least part of the main material flow, thereby uniformly to emulsify the material before a final chopping action by an additional rotary cutter assembly disposed near the output end of the attachment.

9 Claims, 3 Drawing Sheets

FOOD PROCESSING APPARATUS

BACKGROUND OF THE INVENTION

1. Field of the Invention

The invention relates generally to food processing apparatus and, more particularly, to food processing apparatus operating in the manner of a meat grinder for cutting, mixing and emulsifying comestibles.

Such apparatus are primarily utilized for the diminution of organic substances. They may be used, for instance, to cut or chop meats, as well as fruits, vegetables and cheeses. In particular, such apparatus are widely used by butchers and sausage factories for cutting up or finely chopping raw and boiled meats as well as fats and rinds to produce therefrom, in a single operation, varieties of sausages and meat products, or, by a double chopping process, ground meat (hamburger) of uniform grain distribution.

2. The State of the Art

Machines and apparatus of this kind are generally structured as meat grinders in which the material to be chopped is transported by a feed screw or auger in a meat grinder housing toward a rotary knife arrangement. While the meat to be chopped is subjected simultaneously to uniform feed pressure, pressing through a perforated disk and cutting, very little, if any, mixing or distributive action is taking place.

Meat grinders equipped with two consecutively arranged feed screws providing a double chopping action, are well known. It has, however, been found that these machines cannot provide qualitatively acceptable chopping, mixing and emulsification of the ground material.

OBJECTS OF THE INVENTION

It is, therefore, an object of the present invention to provide a cutting or chopping, mixing and emulsifying system for food cutting machines such as meat grinders.

Another object of the invention is to provide such an apparatus for chopping, repeatedly mixing and emulsifying organic materials, such as meats, in a single operation.

Yet another object of the invention is to provide a system of the kind referred to in which two chopping operations may be continuously carried out in a single operation.

It is also an object of the invention to provide an apparatus in which a plurality of operations, such as multiple chopping, mixing and emulsifying are combined into a single through-feed operation for producing sausage dough.

Moreover, it is an object of the invention to provide an apparatus of the kind referred to for chopping, mixing and emulsifying meats, in which the emulsifying action may be selectively avoided.

It is another object of the invention to provide an apparatus of the kind referred to in which the degree of emulsification is adjustable to accommodate materials of different consistencies.

BRIEF SUMMARY OF THE INVENTION

In the accomplishment of these and other objects, the invention, in a preferred embodiment thereof, provides for a meat grinder attachment or attachment connectable to the housing of a meat grinder by a flanged sleeve nut and provided in its feed barrel with a feed screw of at least one thread the individual convolutions of which are selectively provided with perforations functioning as overflow and deflecting channels.

Other objects will in part be obvious and will in part appear hereinafter.

BRIEF DESCRIPTION OF THE SEVERAL DRAWINGS

The novel features which are considered to be characteristic of the invention are set forth with particularity in the appended claims. The invention itself, however, in respect of its structure, construction, lay-out, and design, as well as manufacturing techniques, together with other objects and advantages thereof, will be best understood from the following description of preferred embodiments when read with reference to the appended drawings, in which:

DETAILED DESCRIPTION OF THE PREFERRED EMBODIMENT

Figure 1:
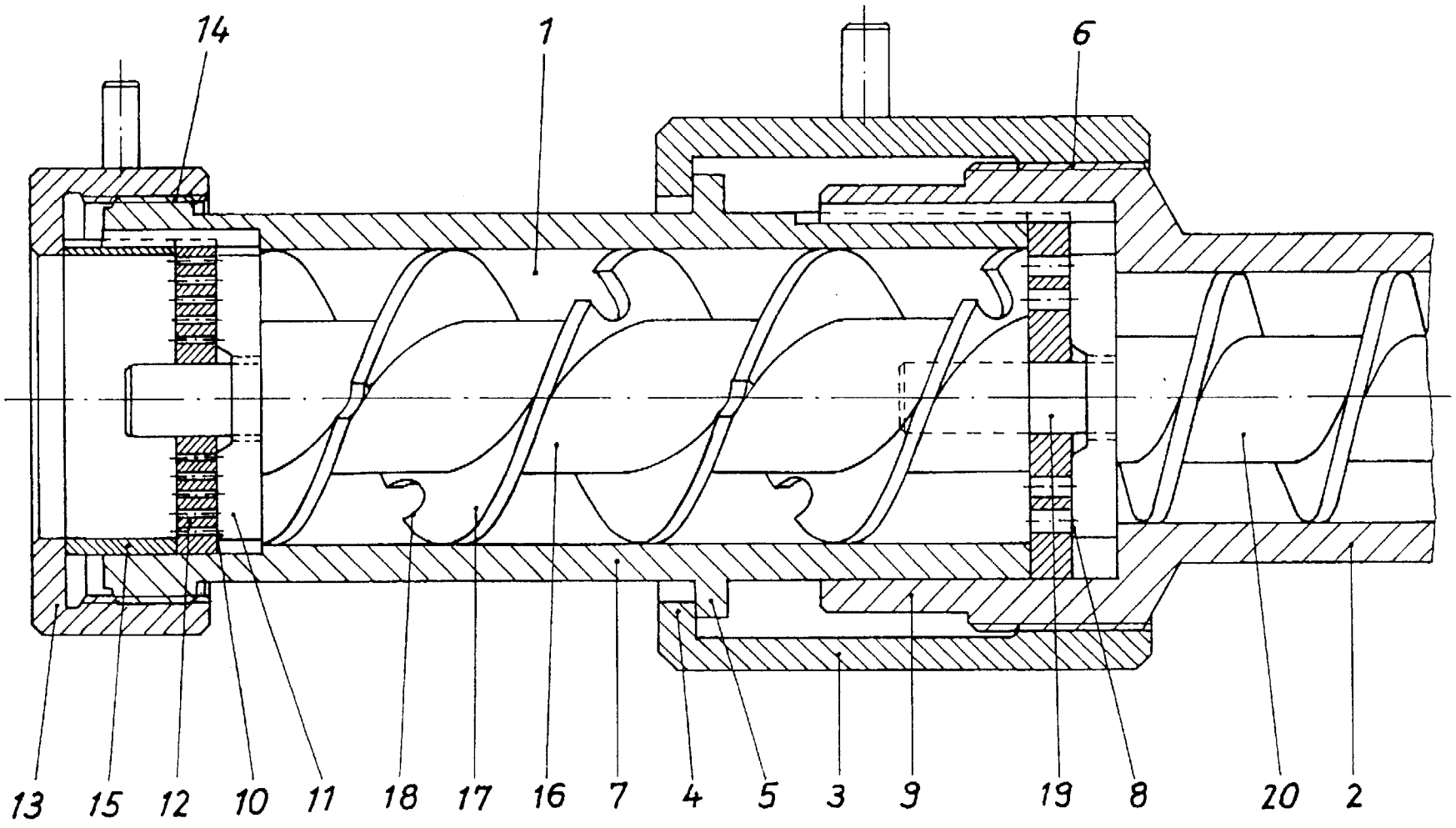
FIG. 1 is a side elevation partly in longitudinal section of a chopping, mixing and emulsifying apparatus in accordance with the invention.

FIG. 1 depicts a chopping, mixing and emulsifying system 1 in accordance with the invention. The system is attached to the pressure or feed barrel 2 of a meat grinder and is secured to it by a flanged sleeve nut 3. To this end, the sleeve nut 3 is provided with an internal thread 6 and an abutment flange 4 for engaging an annular abutment 5 surrounding a feed and pressure housing 7. By rotating the sleeve nut 3 the feed and pressure housing 7 may be positively engaged and aligned with the pressure barrel 2 of the meat grinder, and a first cutter assembly 8 provided in the pressure barrel 2 will be secured.

The feed and pressure housing 7, hereinafter sometimes referred to as a barrel, is structured as a cylinder and is inserted into the cutter housing 9 of the first cutter assembly 8 where it is secured against rotating by a groove and feather (not shown). At its output end, the feed and pressure barrel 7 is structured to receive a second cutter assembly 10 consisting of a rotary knife 11 and a perforated disk 12. The second cutter assembly 10 is secured against axial displacement within the barrel 7 by a ring 15 held in position by another flanged sleeve nut 13. For receiving the sleeve nut 13, the barrel 7 is provided with an external thread 14. It will be seen that in addition to securing the axial position of the second cutter assembly 10, the ring 15 also secures a feed screw 16 within the barrel 7.

The feed screw 16 of the novel system positioned within the barrel 7 may be a single or multiple flute screw. The flutes 17 are provided with openings 18 functioning as overflow and deflection channels. The openings 18 have been depicted as notches positioned in the periphery of the flute at predetermined distances from each other.

The disposition of the openings 18 in the flutes 17 of the feed screw 16 is arranged in accordance with a predetermined system which ensures separation of the material to be conveyed by the screw 16 into a plurality of partial flows or currents. It also ensures that the partial currents are repeatedly reverse fed, divided and deflected to yield excellent mixing and emulsification.

The feed screw 16 is keyed to a knife stud 19 of a feed screw 20 of the meat grinder by a recess 22 in a shaft 21 of the screw 16 receiving the stud 19 of the screw 20.

Figure 2:
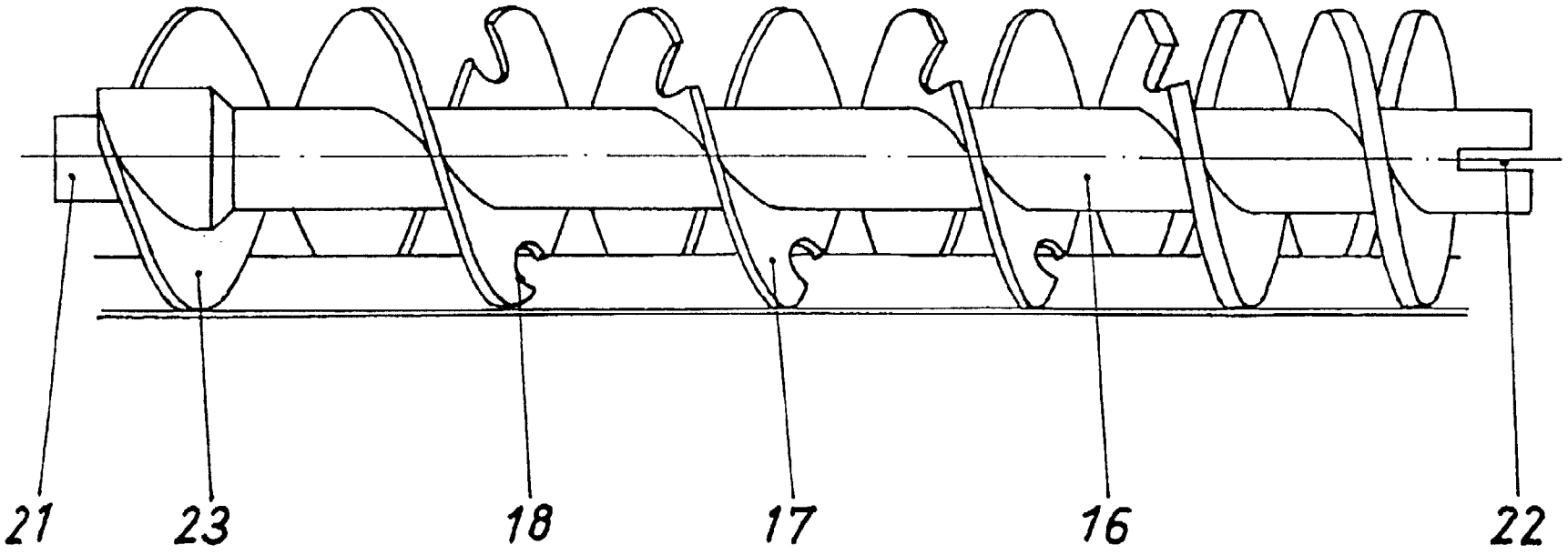
FIG. 2 is a side view of a feed screw of an apparatus in accordance with the invention.

A feed screw 16 structured according to the invention is shown in FIG. 2. The feed screw 16 will be seen to consist of two components, to wit, a metal shaft 21 and a screw body 23. The body 23 is preferably made from a polymeric material, such as, for instance, high-density polyethylene, but it may also be made from another suitable non-metallic material.

Figure 3:
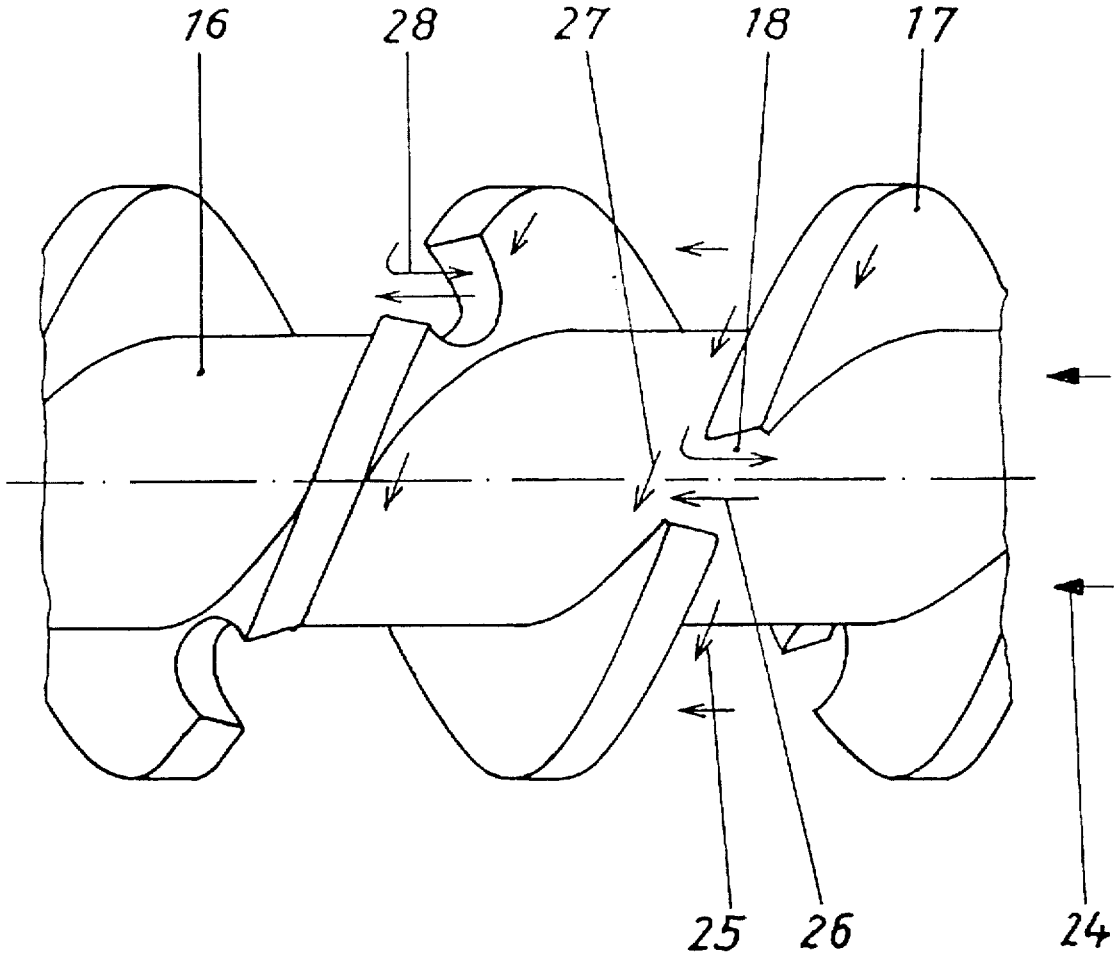
FIG. 3 is a sectional view of the feed screw of FIG. 2 depicting a flow pattern.

The openings 18 in individual flutes 17 of the screw 16 have a convex bottom portion which positively affects the feed and flow pattern or behavior of the material to be chopped. Since the edges are rounded off, there will be no corners which could interfere with the separation, deflection, overflow and reverse flow process. The manner in which the individual currents of the material to be chopped are separated, deflected and reversed is depicted by the arrows or flow diagram of FIG. 3.

Initially, the material to be chopped flows from the first cutter assembly 8 into the feed and pressure barrel 7 and impacting on the feed screw 16 in the direction indicated by arrows 24. As a result of the continuous feeding this material to be chopped meets the screw flutes 17 and is conveyed further because of the rotary movement and pitch of the feed screw 16. It impacts a first screw flute 17, and is initially conveyed further because of the pitch, is deflected and slides along the inclines of the screw flutes 17 up to an opening 18. At this point, the entire material flow 24 divides. A portion of it passes by the openings 18 following the respective screw flute 17, whereas another portion penetrates through the openings 18 in directions indicated by arrows 25 and 26. That part of the flow indicated by arrow 26 is seised and conveyed by the flow gliding along the opposite side of the screw flute 17 and indicated by arrow 27 and is deflected again by the following screw flute 17 which again leads to a division of the flow. As a result of this deflection a portion of the entire material to be chopped is again deflected in the direction of arrow 28 and in part returns through the openings 18 to the preceding space where it is seised and conveyed on by the following flow.

The heterogenous materials are folded over or kneaded several times by the multiple division and deflection during the conveying operation. They are mixed leading to a homogenous mixture which favorable affects the quality of the final product.

After the material to be chopped has been fed along by the feed screw 16 being thereby repeatedly folded over, mixed together and resulting in the end in a homogenous mixture, it will arrive at the second cutter assembly 10 where it will be subjected to fine-chopping for quality enhancement.

The ratio of the sizes of the bores in the perforated disks utilized in the two cutter assemblies 8 and 10 has an immediate effect on the degree of emulsification of the chopped material and may be significantly affected by the choice of the perforated disks used. For the openings or through-bores in the perforated disks influence the manner of emulsification as well as the degree of emulsification.

The following list of possible combinations of perforated disks utilized in the two cutter assemblies 8 and 10 result in the following degrees of emulsification:

| Perforated Disk in cutter assembly 8: Bore Sizes: | Perforated Disk in cutter assembly 10: Bore Sizes: | Ratio of Perf. Disks: | Degree of Emulsification: |
|---|---|---|---|
| 1.5 mm | 3 mm | .5:1 | high |
| 3 mm | 3 mm | 1:1 | low |
| 6 mm | 3 mm | 2:1 | none/very low |

GENERAL DISCUSSION OF THE INVENTION

The proposed invention relates to a feeding and mixing system provided with a cutting system and combinable with a food chopping machine, in particular with a meat grinder.

The invention provides for all the element required for chopping and emulsifying being mounted in a housing which itself constitutes an attachment and which may be connected to a commercial meat grinder.

The core of the invention is a feed screw with single or multiple flutes of varying pitch and provided with openings structured as overflow channels which provide for an overflow as well as, in particular, for a deflection of the material to be processed. It results in an exchange and intermixing of materials with which products of uniform consistency may be produced.

The overflow channels provide for an exchange of material flows up to the cutter assembly located at the output end of the feed screw, where the material is again chopped resulting in a uniform granular distribution of fat and lean meat proportions.

Pre-chopped material is pressed into the novel feeding and mixing system by the continuous feeding operation of the meat grinder. Because of the pitch of the feed screw of this system pressure is increased and contributes to the multiple mixing and deflection of the material flows forming in the flues of the screw by the openings. A certain partial flow is conveyed in the feed direction whereas other portions are reverse fed and deflected in a direction opposite the feed direction until it is again deflected into another direction of feed by the next screw flute. During this dividing and deflecting of the material flows the material is repeatedly mixed. This affects positively the formation of a homogenous mixture. The homogenous mixture can then be fed directly to the following cutter assembly to be reduced to the desired grain size.

The special structure of the feed screw does not only ensure the formation of a homogenous mixture but also that sufficient pressure is built up to chop the material according to required quality in a second cutting process and that it is ejected from the apparatus in a controllable manner.

A dual chopping process reduces the strain on the meat, substantially lowers the operating temperature and thus lowers the development and presence of germs, in ground meat in particular.

As has already been mentioned, the invention may advantageously but need not be embodied in an accessory or attachment for meat grinders, and is made up of a pressure barrel which may be connected to the pressure barrel of a meat grinder by the simple expedient of a flanged sleeve nut.

As well as the feed screw the second cutter assembly is mounted in the pressure barrel of the apparatus, the feed screw being structured for positive engagement with a rotary stud of the first cutter assembly. Feed screw and cutter assembly of the appliance are axially braced by a sleeve nut. When mounted on the meat grinder, the appliance acts as a spacer ring for the cutter assembly of the meat grinder. The feed or emulsifier screw of the appliance is driven by its connection with the knife stud of the feed screw of the meat grinder.

Another advantage is obtained by structuring the feed or emulsifying screw of the appliance with a single or with multiple flutes the pitches of which are directly related to the kind of material to be processed.

Thus, if beef is being processed, the pitch of the screw should preferably be in the range of from 60 to 120 mm. For processing pork, the pitch preferably is in the range of from 30 to 80 mm; and if boiled meat is to be processed the pitch should preferably range between about 10 to 50 mm.

The novel apparatus draws upon the realization that because of the final perforated disk only as much raw material can be accepted and chopped as results from the volume of the material to be chopped which is present between two flutes of the feed screw. This in turn, is the reason for the variation in the pitch of the feed screw and, more particularly, of the structure of the feed screw provided with openings for dividing and deflecting the material flows for returning it to the feeding process, so that it may in the end be subjected as a homogenous mixture to final chopping. The emulsifying effect may be positively influenced or defined by configuration and number of the openings functioning as overflow channels. This may be accomplished, for instance, by doubling the number of overflow channels, or by enlarging or doubling the size of their cross sectional area.

The emulsifying effects are of particular importance in respect of the kinds of sausage dough required for the production of scalded or boiled sausages.

Having described our invention, what we claim is:

1. A food processing apparatus for chopping and mixing food dispensed in a substantially single flow by a meat grinder provided with coaxially aligned pressure barrel, feed auger and rotary cutter assembly, said apparatus comprising:

a feed and pressure barrel forming a substantially cylindrical interior wall and comprising an input end and an output end;

means for substantially coaxially connecting the feed and pressure barrel to the pressure barrel of the meat grinder, with the input end facing the rotary cutter assembly thereof;

a feed screw coaxially mounted for rotation in the feed and pressure barrel and comprising a drive shaft and at least one substantially helical flute connected thereto and extending between the input end and the output end, the flute being provided with an apical portion adapted glidingly to engage the cylindrical wall of the feed and pressure barrel;

a plurality of openings in the apical portion distributed along the length of the feed screw for repeatedly dividing the single flow and for deflecting at least a part thereof into a direction different from the feed direction of the feed screw thereby to impart thorough mixing and kneading of the food;

means for connecting the drive shaft to the feed auger for rotation therewith; and a rotary cutter disposed in the feed and pressure barrel at the output end thereof.

2. The apparatus of claim 1, wherein the openings are configured as notches in the periphery of the flutes at predetermined distances from each other.

3. The apparatus of claim 2, wherein the notches comprise convexly curved transition surfaces for ensuring dividing, deflecting and reverse flow of the single flow of food.

4. The apparatus of claim 1, wherein the screw body means is made from a polymeric material.

5. The apparatus of claim 4, wherein the polymeric material is high-density polyethylene.

6. The apparatus of claim 1, wherein the rotary cutter assembly and the rotary cutter means respectively comprise perforated disk and wherein the ratio of the size of the perforations in one disk relative to the size of the perforations in the other disk ranges between 0.5:1 and 2:1.

7. The apparatus of claim 1, wherein the pitch of the flutes is between 60 and 120 mm.

8. The apparatus of claim 1, wherein the pitch of the flutes is between 30 and 80 mm.

9. The apparatus of claim 1, wherein the ratio of the pitch is between 10 and 50 mm.

* * * * *